US005901421A

United States Patent [19]

Lee et al.

[11] Patent Number: 5,901,421

[45] Date of Patent: May 11, 1999

[54] PULL TAB OF THE ZIPPER HEAD

[76] Inventors: Li-Hsin Lee, No. 4, Lane 101, Chang Hsin 1 St., Ta-Li City, Taichung Hsien; Shih-Chang Lin, No.102, Lane 222, Hsin Chung Road, Ho Mei Chen, Chang Huw Hsien; A-Shin Chen, No. 56, Lane 26, Fu Jeng Road, Fu Hsin Hsian, Chang Huw Hsein, all of Taiwan

[21] Appl. No.: 09/084,216

[22] Filed: May 26, 1998

[51] Int. Cl.[6] ..... A44B 1/04

[52] U.S. Cl. ..... 24/429; 24/431

[58] Field of Search ..... 24/429, 430, 431

[56] References Cited

U.S. PATENT DOCUMENTS 4,920,615 5/1990 Aoki et al. ..... 24/429

5,093,966 3/1992 Yuki et al. ..... 24/429

*Primary Examiner*—James R. Brittain

*Attorney, Agent, or Firm*—Browdy and Neimark

[57] ABSTRACT

A pull tab of the zipper head is composed of a pull piece and an elastic piece. The pull piece has a beam, a hook, and an insertion slot located between a fastening end of the hook and the beam. The hook has an open end. The elastic piece has an inner body, an outer body, a curved portion, and two urging portions. The elastic piece is engaged with the pull piece such that the inner body is located in the insertion slot, and that the open end of the hook is sealed off by the outer body, and further that the curved portion is located across the beam, and still further that the two urging portions urge the beam. The elastic piece is thus securely engaged with the pull piece.

4 Claims, 4 Drawing Sheets

PULL TAB OF THE ZIPPER HEAD

FIELD OF THE INVENTION

The present invention relates generally to a zipper, and more particularly to a pull tab of the zipper.

BACKGROUND OF THE INVENTION

As shown in FIG. 1, a prior art zipper head 10 has a head 12, a pull tab 13 fastened with the head 12, and a pulling member 14 fastened with the pull tab 13 to facilitate the pulling of the pull tab 13. Located between pull tab 13 and the pulling member 14 is a retaining ring 15 which is engaged with a hook 16 of the pull tab 13. Such a prior art zipper head 10 as described above is defective in design in that the hook 16 must be made by molding, and that the hook 16 is not cost-effective, and further that the rejection rate of the hook 16 is relatively high.

As shown in FIGS. 2 and 3, another prior art zipper head 20 has a pull tab 23 with a hooked portion 24. Located between the hooked portion 24 and a beam 25 of the pull tab 23 is an insertion slot 26 in which a body 271 of a U-shaped elastic piece 27 is lodged such that the curved portion 273 is connected with the beam 25, and that an opening of the hooked portion 24 is sealed off by the body 272. This prior art zipper head 20 is defective in design in that the elastic piece 27 is poorly located, and that the elastic piece 27 is thus prone to become disengaged with the insertion slot 26. The improved version of the zipper head 20 is provided with two protruded portions 28, which are fastened with the curved portion 273 of the elastic piece 27 by rivets. Such an improved version of the zipper head 20 is not cost-effective, and that the protruded portions 28 are too small to fasten securely with the elastic piece 27.

As shown in FIGS. 4 and 5, the prior art zipper head 30 has an elastic piece 35. The elastic piece 35 has a body 351, which is provided with an elastic urging portion 36. As the elastic piece 35 is inserted into the beam 33 and the insertion slot 34 of the pull tab 31, the urging portion 36 urges the beam 33 so as to bring about the locating effect. The elastic piece is capable of bringing about a better locating effect and can be easily assembled. However, the zipper head of the present invention is defective in design in that the front end of the ring portion 38 of the pull member 37 is extended into a place located between the two piece bodies 351 and 352 at the time when the pull member 37 is in use, and that the front end of the ring portion 38 puts a pressure on the urging portion 36, thereby causing the free end of the urging portion 36 to be pushed. The urging portion 36 is no longer urging the beam 33. As a result, the elastic piece 35 is prone to become disengaged with the pull tab 31.

SUMMARY OF THE INVENTION

The primary objective of the present invention is therefore to provide a zipper head with a pull tab which is free from the drawbacks of the prior art pull tabs described above.

The objective, features, functions and advantages of the present invention will be readily understood upon a thoughtful deliberation of the following detailed description of the present invention with reference to the accompanying drawings.

DETAILED DESCRIPTION OF THE INVENTION

Figure 1:
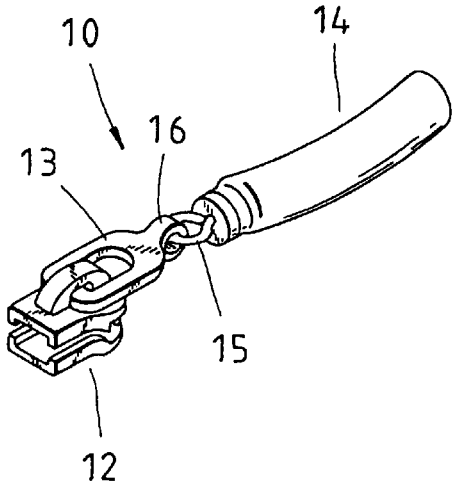
FIG.1 PRIOR ART
FIG. 1 shows a perspective view of a first prior art zipper head.
Figure 2:
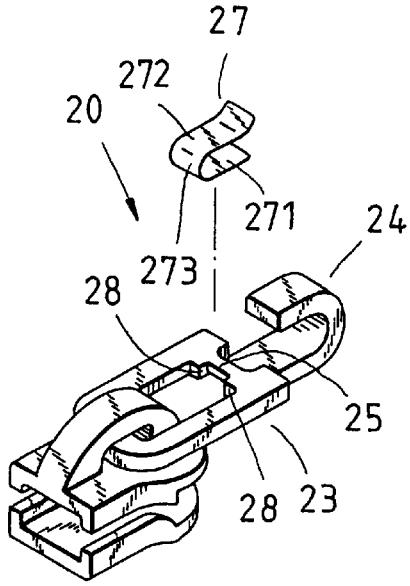
FIG. 2 PRIOR ART
FIG. 2 shows an exploded view of a second prior art zipper head.
Figure 3:
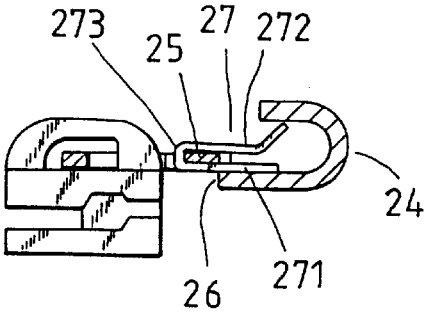
FIG. 3 PRIOR ART
FIG. 3 shows a sectional view of the second prior art zipper head in combination.
Figure 4:
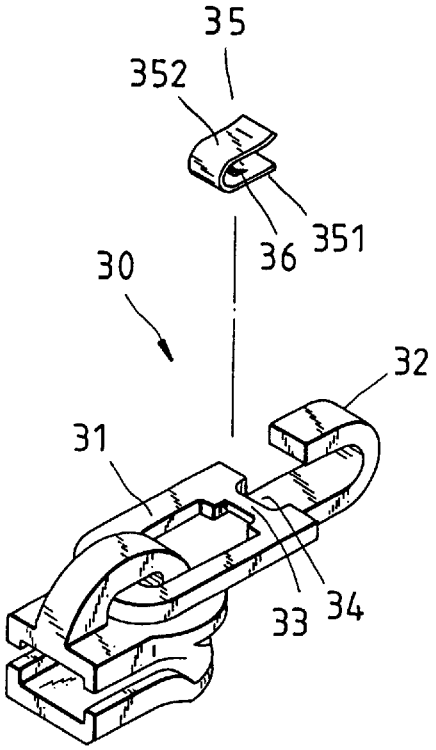
FIG. 4 shows an exploded view of a third prior art zipper head.
Figure 5:
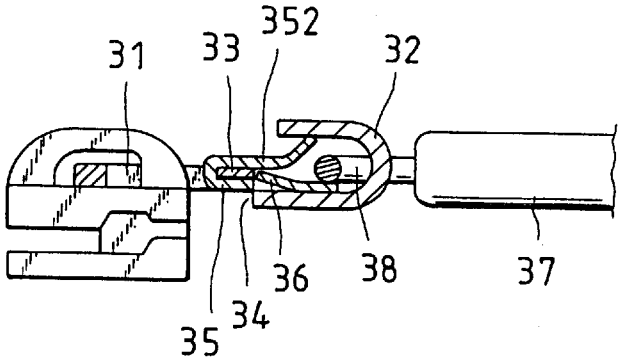
FIG. 5 shows a partial longitudinal sectional view of the third prior art zipper head in combination.
Figure 6:
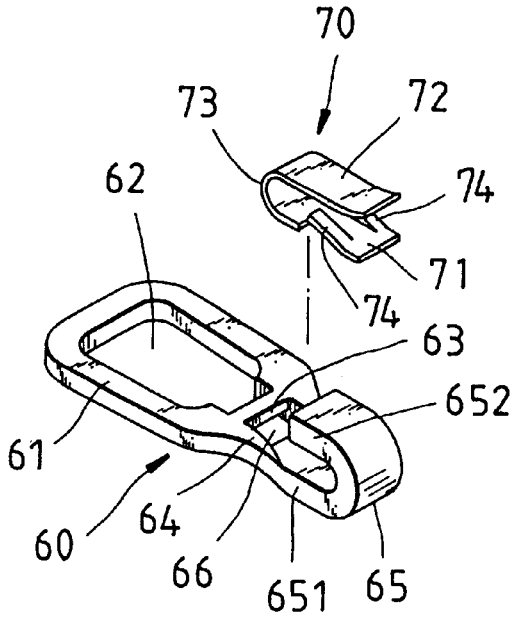
FIG. 6 shows a top view of the present invention.
Figure 7:
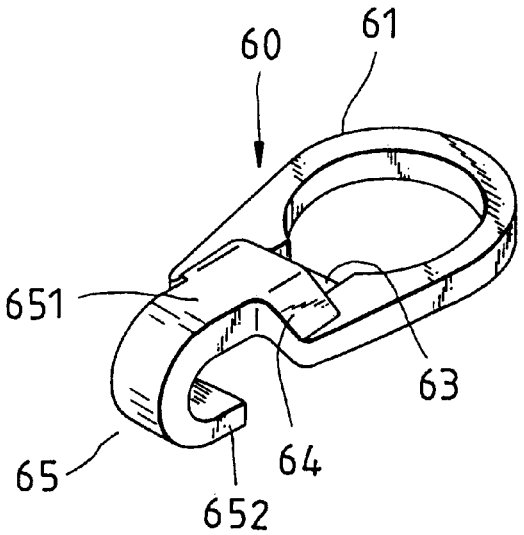
FIG. 7 shows a bottom view of a pull tab of the present invention.

As shown in FIGS. 6 and 7, a pull tab 40 embodied in the present invention is intended for use in a zipper head and is composed of the component parts, which are described explicitly hereinafter.

Figure 8:
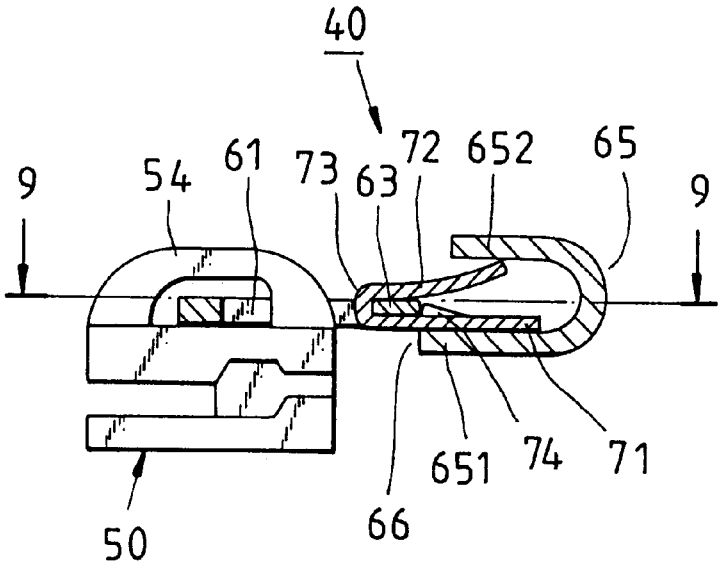
FIG. 8 shows a partial longitudinal sectional view of the present invention.

A pull piece 60 has a flat platelike body 61 which is provided with a through hole 62, a beam 63 located at one end of the body 61, and a U-shaped hook 65 corresponding in location to the beam 63. Located between a fastening end 651 of the hook 65 and the beam 63 is an insertion slot 66. The hook 65 has an open end 652 which is located at another end of the hook 65 such that the open end 652 is separated from the body 61 at an interval. Both sides of the end, where the beam 63 is located, are provided respectively with a wall extending outwards and having an inclined wall surface 64. The fastening end 651 of the hook 65 is fastened with these two inclined surfaces 64 so as to form the insertion slot 66 along with the beam 63. The through hole 62 of the pull piece 60 is engaged with a connection portion 54 of the head 50 of the zipper head, as shown in FIG. 8.

An elastic piece 70 is of a U-shaped construction and is composed of two bodies 71 and 72, and a curved portion 73 connecting the two bodies 71 and 72. The inner body 71 is provided with two urging portions 74 located between the two bodies 71 and 72. The urging portions 74 are made integrally on the inner body 71 by punching and pressing. The free ends of the urging portions 74 are capable of swinging toward the outer body 72 and the curved portion 73 of the elastic piece 70.

Figure 10:
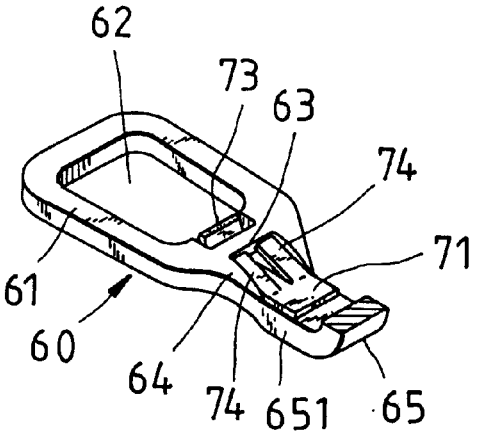
FIG. 10 shows a partial sectional view of the present invention in combination.
Figure 9:
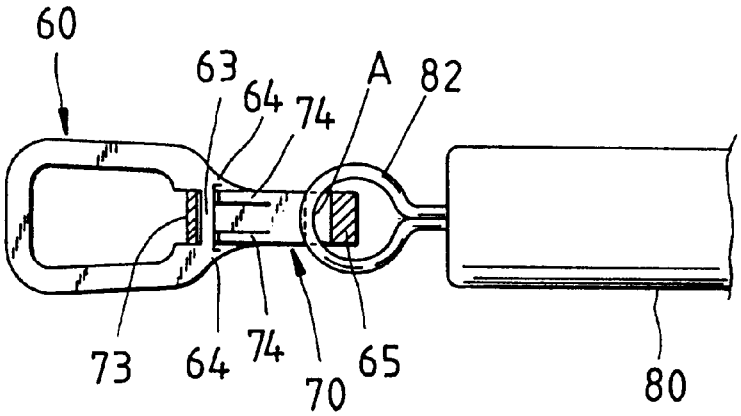
FIG. 9 shows a sectional view of a portion taken along the direction indicated by a line 9—9 as shown in FIG. 8.

In combination, the inner body 71 is lodged in the insertion slot 66 of the pull piece 60 such that the curved portion 73 is located on the beam 63, and that the inner body 71 is in contact with the inner wall of the fastening end 651 of the hook 65, and further that the outer body 72 is in contact with the inner wall of the open end 652 of the hook 65. As a result, the open end of the hook 65 is sealed off. As the elastic piece 70 is located, the free ends of the two urging portions 74, press against beam 63 as shown in FIGS. 8, 9 and 10, so as to prevent the elastic piece 70 from being pulled out of the insertion slot 66. In the meantime, the two urging portions 74 are contiguous to the two inclined walls 64, as shown in FIGS. 9 and 10.

In the process of connecting the pull tab 40 of the present invention with the pull member 80, the retaining ring 82 of the pull member 80 compresses the outer body 72 of the elastic piece 70 such that the retaining ring 82 can be inserted into the hook 65 via the gap created between the outer body 72 and the open end 652 of the hook 65, and that the pull member 80 is connected with the pull piece 60.

The elastic piece 70 can be easily inserted without interfering with the urging portions 74. As soon as the elastic piece 70 is located, the urging portions 74 press against the beam 63 so as to secure the elastic piece 70.

What is claimed is:

1. A pull tab of a zipper head, said pull tab comprising:

a pull piece having a body which is provided at one end thereof with a beam, a U-shaped hook corresponding in location to said beam and having a fastening end, both sides of said fastening end being connected respectively to a wall such that an insertion slot is formed between said fastening end and said beam, said hook having an open end located at a free end of said hook, said pull piece for use in engaging a head of the zipper head; and an elastic piece of a U-shaped construction and having an inner body, an outer body, and a curved portion connecting said inner body and said outer body, said inner body being engaged in said insertion slot, said open end of said hook being sealed off by said outer body, said curved portion being engaged on said beam;

wherein said elastic piece is provided with two urging portions located between said inner body and said outer body, said elastic piece being inserted into said pull piece such that said two urging portions of said elastic piece press against the beam of said pull tab so as to secure said elastic piece in said insertion slot.

2. The pull tab as defined in claim 1, wherein said two urging portions are made integrally with one of said two bodies by punching and pressing such that said two urging portions swing toward another one of said two bodies, and that free ends of said two urging portions swing toward said curved portion.

3. The pull tab as defined in claim 1, wherein said inner body of said elastic piece is located in said insertion slot; and wherein said two urging portions are located on said inner body.

4. The pull tab as defined in claim 1, wherein said inner body of said elastic piece is located in said insertion slot; and wherein said two urging portions are located on said outer body.

* * * * *